US007207267B2

(12) United States Patent
Salvestro et al.

(10) Patent No.: US 7,207,267 B2
(45) Date of Patent: Apr. 24, 2007

(54) APPARATUS AND METHOD FOR MANIPULATION OF SLEEVES ON A CYLINDER

(75) Inventors: Aldo Salvestro, Burnaby (CA); Lon McIlwraith, Delta (CA)

(73) Assignee: Kodak Graphic Communications Canada Company, British Columbia (CA)

( * ) Notice: Subject to any disclaimer, the term of this patent is extended or adjusted under 35 U.S.C. 154(b) by 221 days.

(21) Appl. No.: 10/944,724

(22) Filed: Sep. 21, 2004

(65) Prior Publication Data

US 2005/0061177 A1 Mar. 24, 2005

Related U.S. Application Data

(60) Provisional application No. 60/504,975, filed on Sep. 23, 2003.

(30) Foreign Application Priority Data

Sep. 22, 2003 (CA) ..... 2442051

(51) Int. Cl.
*B41F 13/10* (2006.01)

(52) U.S. Cl. ..... 101/375; 101/376; 101/480

(58) Field of Classification Search ..... 101/216, 101/375, 376, 477, 480, 485
See application file for complete search history.

(56) References Cited

U.S. PATENT DOCUMENTS

| | | | | |
|---|---|---|---|---|
| 4,144,812 | A * | 3/1979 | Julian | 101/382.1 |
| 4,903,597 | A | 2/1990 | Hoage et al. | |
| 5,735,206 | A * | 4/1998 | Rossini | 101/216 |
| 6,578,483 | B2 * | 6/2003 | Compera et al. | 101/375 |
| 2003/0000402 | A1 * | 1/2003 | Walczak et al. | 101/375 |
| 2004/0139873 | A1 * | 7/2004 | Gottling et al. | 101/375 |

OTHER PUBLICATIONS

Applicant's own prior art disclosure; copies of photographs of May 2000 disclosure event.

* cited by examiner

*Primary Examiner*—Judy Nguyen
*Assistant Examiner*—Kevin D. Williams

(57) ABSTRACT

A method and apparatus are provided for the manipulation of a sleeve onto and off of a cylinder. A sleeve mounted on a handling shaft is equipped with a substantially airtight slideable end cap at its distal end. During mounting, axial alignment is provided when the handling shaft is engaged with the free end of the cylinder. A plurality of apertures on the cylinder's exterior surface conduct pressurized air, which expands the sleeve by exerting radial fluid pressure on its inside surface. A vacuum source actively evacuates the air from the sleeve's interior drawing the sleeve onto the cylinder. To remove the sleeve fluid pressure is reasserted exerting an axial force against the substantially airtight end cap. An auxiliary air supply is selectively activated to aid in sleeve removal.

16 Claims, 5 Drawing Sheets

FIG. 2-A
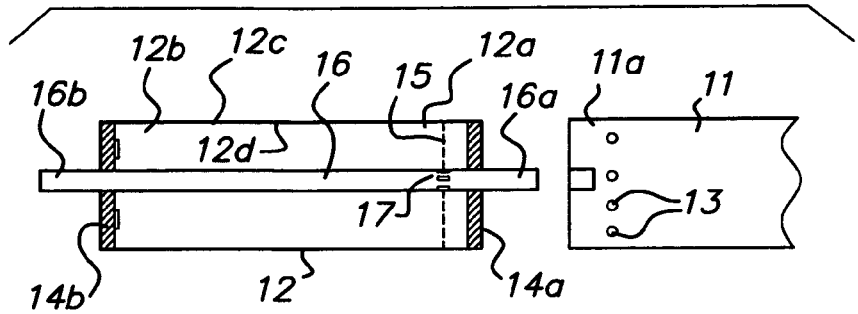
FIG. 2-B
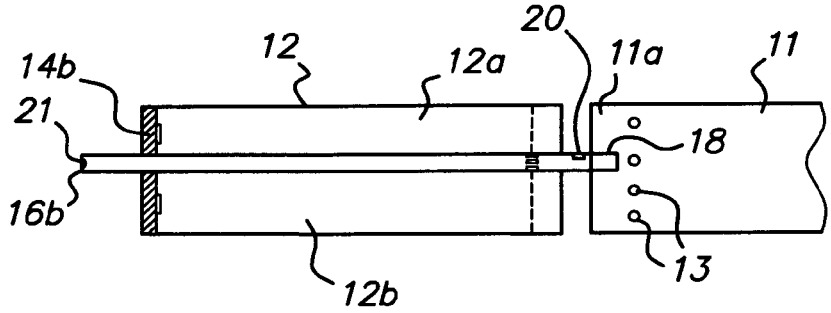
FIG. 2-C
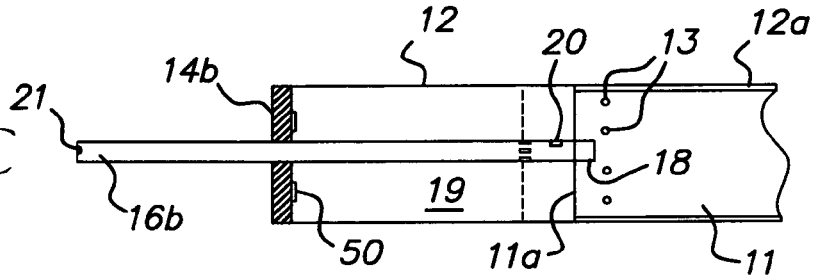
FIG. 2-D
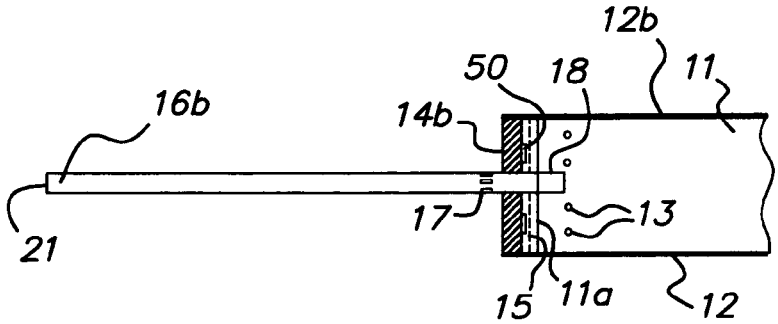

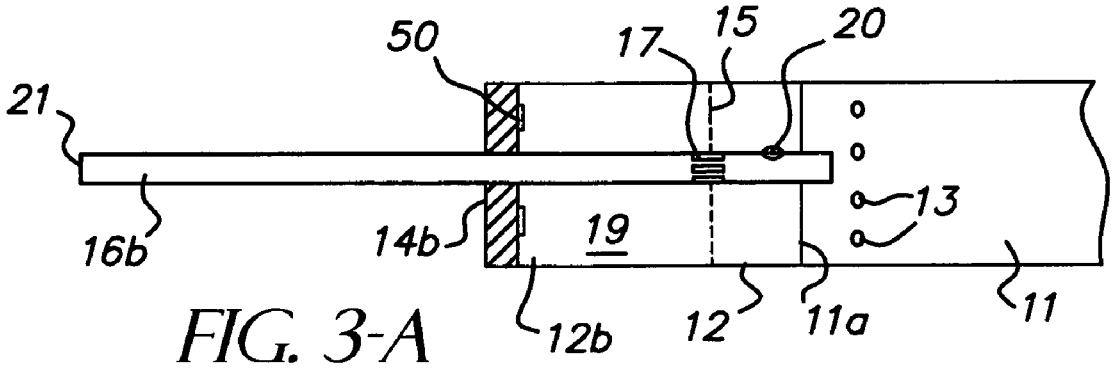
FIG. 3-A
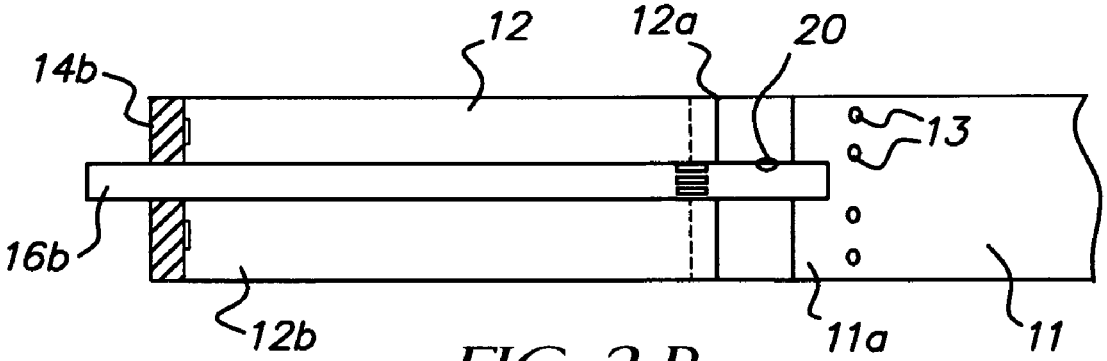
FIG. 3-B
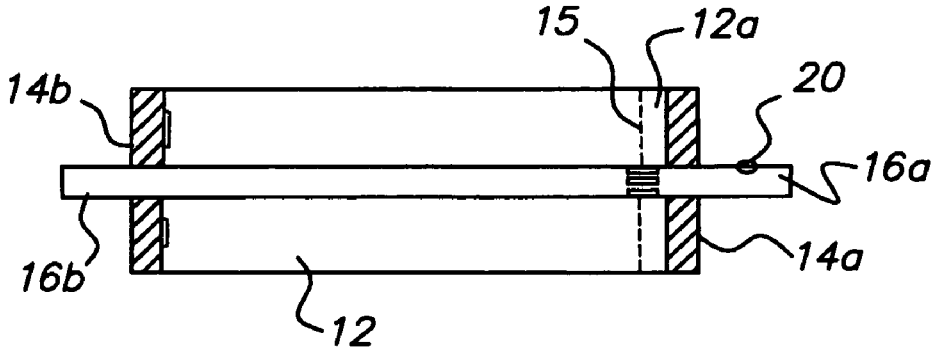
FIG. 3-C

APPARATUS AND METHOD FOR MANIPULATION OF SLEEVES ON A CYLINDER

REFERENCE TO RELATED APPLICATION

This application claims the benefit of U.S. application 60/504,975 filed on 23 Sep. 2003, which is hereby incorporated herein by reference in its entirety and claims priority from Canadian patent application No. 2,442,051 filed on 22 Sep. 2003.

TECHNICAL FIELD

This invention relates to the preparation and handling of printing sleeves for a printing press.

BACKGROUND

Hollow cylindrical sleeves are often employed in flexographic printing as a means of quickly mounting and dismounting plates on imaging cylinders, printing press cylinders, storage cylinders, and other cylinder-based equipment. For various reasons, it is generally desirable to avoid touching the surface of the un-processed media normally mounted on the sleeve's outer cylindrical surface. Avoiding touching the media surface is particularly difficult while the sleeve is being handled during mounting and dismounting from the cylinder. With the more recent desire to image the media directly on the sleeve, the care required in handling the sleeve is even more critical.

Typically, the sleeves used in flexographic printing are tubular in form and made of composite, polymer, or metal. Sleeves are commonly affixed to the printing cylinder using an interference fit i.e. the free-state circumference of the sleeve's interior surface is less than or equal to the circumference of the exterior surface of the cylinder. The requirement for an interference fit presents problems related to the mounting and dismounting of sleeves from the cylinder.

A common method for mounting and dismounting sleeves is described in U.S. Pat. No. 4,903,597 to Hoage at. al. Hoage et al. disclose introducing fluid pressure between the exterior cylindrical surface of the cylinder and the interior cylindrical surface of the sleeve. This method is schematically depicted in FIG. 1. Cylinder 11 is supported in a cantilevered condition with a free end 11*a* ready to receive a sleeve 12. The proximate end 12*a* of a sleeve 12 is initially forced onto free end 11*a* of a cylinder 11. After the sleeve 12 has been pushed a short way onto cylinder 11, a fluid pressure is established via small apertures 13 in the exterior surface of cylinder 11. The fluid pressure (commonly pressurized air) exerts radial force on the sleeve 12, expanding it slightly and creating an air bearing on which the sleeve 12 may be slid onto the cylinder 11. When the sleeve 12 is in the desired location relative to the cylinder 11, the fluid pressure is removed and the sleeve 12 shrinks to its regular size, forming an interference fit on the cylinder 11. It is advantageous if the apertures 13 are located relatively close to the free end 11*a* of the cylinder 11, so that the fluid pressure may be applied in the region where the sleeve initially engages the free end 11*a* of cylinder 11.

There are some problems with this method. One such problem is that the proximate end 12*a* of the sleeve 12 must initially be forced onto the free end 11*a* of cylinder 11 before the air bearing created by the apertures 13 can overcome the interference between the sleeve 12 and cylinder 11. This initial mounting requires accurate axial alignment of sleeve

12 and cylinder 11. Any binding will make it difficult to push sleeve 12 far enough onto cylinder 11 to allow the air bearing to form. As mentioned earlier, the media (not shown) on the exterior surface of the sleeve 12 is sensitive and may not be physically manipulated during this procedure. Even if the sleeve 12 is only manipulated by its distal end 12*a*, there is a significant chance that such manipulation will damage the media on the sleeve's external surface, or damage the sleeve itself.

On completion of imaging the sleeve is usually removed from the imaging cylinder. An air bearing is once again established via apertures 13. The only way to remove sleeve 12 from cylinder 11 is to apply a force to the very thin edge of its proximate end 12*a*. This can damage the printing media, the image carried on the media, or even cylinder 11. Another problem occurs when the proximate end 12*a* of the sleeve 12 gets closer to the free end 11*a* of the cylinder 11*a* during the removal process. In this condition a substantial portion of the sleeve 12 overhangs the cylinder 11, which may cause the sleeve 12 to bind or lock on the cylinder 11. If the sleeve 12 binds on the cylinder 11, one may need to push the sleeve 12 back onto the cylinder 11 and try to remove it again. Obviously, such remounting and dismounting substantially increases the amount of manipulation of (and potential damage to) the sleeve 12 and the sensitive media on its outer surface.

There remains a need for better apparatus and methods for mounting and dismounting sleeves on cylinders.

SUMMARY OF INVENTION

A sleeve, sealed at one end to create a substantially air tight cavity, is drawn onto a cylinder by lowering the pressure in the cavity using a vacuum source and removed from the cylinder by increasing the pressure in the cavity using pressurized air. An auxiliary supply of pressurized air aids in the removal of the sleeve.

In a first aspect of the present invention an apparatus for mounting a tubular sleeve on a cylinder is provided. The cylinder has an open end with at least one air aperture formed in the outer surface of the cylinder proximate the open end for radially expanding the sleeve and providing air bearing flotation thereto. An end cap sealingly engages an end of the sleeve distal to the cylinder open end so that at least a portion of the sleeve is free to engage the open end of the cylinder thus forming a substantially closed cavity between the end cap, the sleeve, and the open end of the cylinder. A vacuum source is provided for selectively evacuating air from the cavity to draw the sleeve onto the cylinder. An auxiliary air supply is provided for introducing air into the cavity to aid in removing the sleeve from the cylinder.

Another aspect of the invention provides a method for mounting a tubular sleeve onto a cylinder. The cylinder has an open end with at least one air aperture formed in the cylinder outer surface proximate the open end. The air aperture is for radially expanding the sleeve and providing air bearing flotation thereto. The open end of the sleeve is engaged on the open end of the cylinder and the end of the sleeve distal to the open end of the cylinder is sealed to create a cavity between the distal end, the sleeve and the cylinder. The sleeve is drawn onto the cylinder by establishing a vacuum in the cavity. The sleeve is removed using pressurized air from the air aperture. Removal is aided by selectively applying auxiliary pressurized air between the cylinder and the sealed end.

Further aspects of the invention and features of embodiments of the invention are set out below.

BRIEF DESCRIPTION OF DRAWINGS

In drawings which illustrate, by way of example only, embodiments of the invention:

FIGS. 2-A–2-D are side views of a sleeve mounting apparatus according to the invention;

FIGS. 3-A–3-C are further side views of the sleeve mounting apparatus;

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

FIG. 2-A, depicts apparatus according to one embodiment of the invention. Sleeve 12 is completely detached from cylinder 11. Sleeve 12 may be made, for example, of composite material, polymer or metal and may carry sensitive imaging media (not shown) on its exterior cylindrical surface 12*c*. Cylinder 11 is the imaging cylinder on which the sleeve-mounted media is to be imaged prior to processing.

FIG. 2-A shows sleeve 12 in a state in which it may be stored prior to use. Sleeve 12 is mounted on a handling shaft 16. An end cap 14*a* is located at the proximate end 12*a* of sleeve 12. A second end cap 14*b* is located at the distal end 12*b* of sleeve 12. End caps 14*a* and 14*b* are annular in shape and each engage an interior cylindrical surface 12*d* of sleeve 12. End caps 14*a* and 14*b* are capable of slideably moving along the exterior surface of handling shaft 16. Distal end cap 14*b* forms a substantially airtight seal with distal end 12*b* of sleeve 12. End cap 14*b* defines one end of a cavity 19 within sleeve 12. End cap 14*a* is not necessarily sealed to sleeve 12 although, for convenience, end caps 14*a* and 14*b* may be the same as one another.

Figure 1:
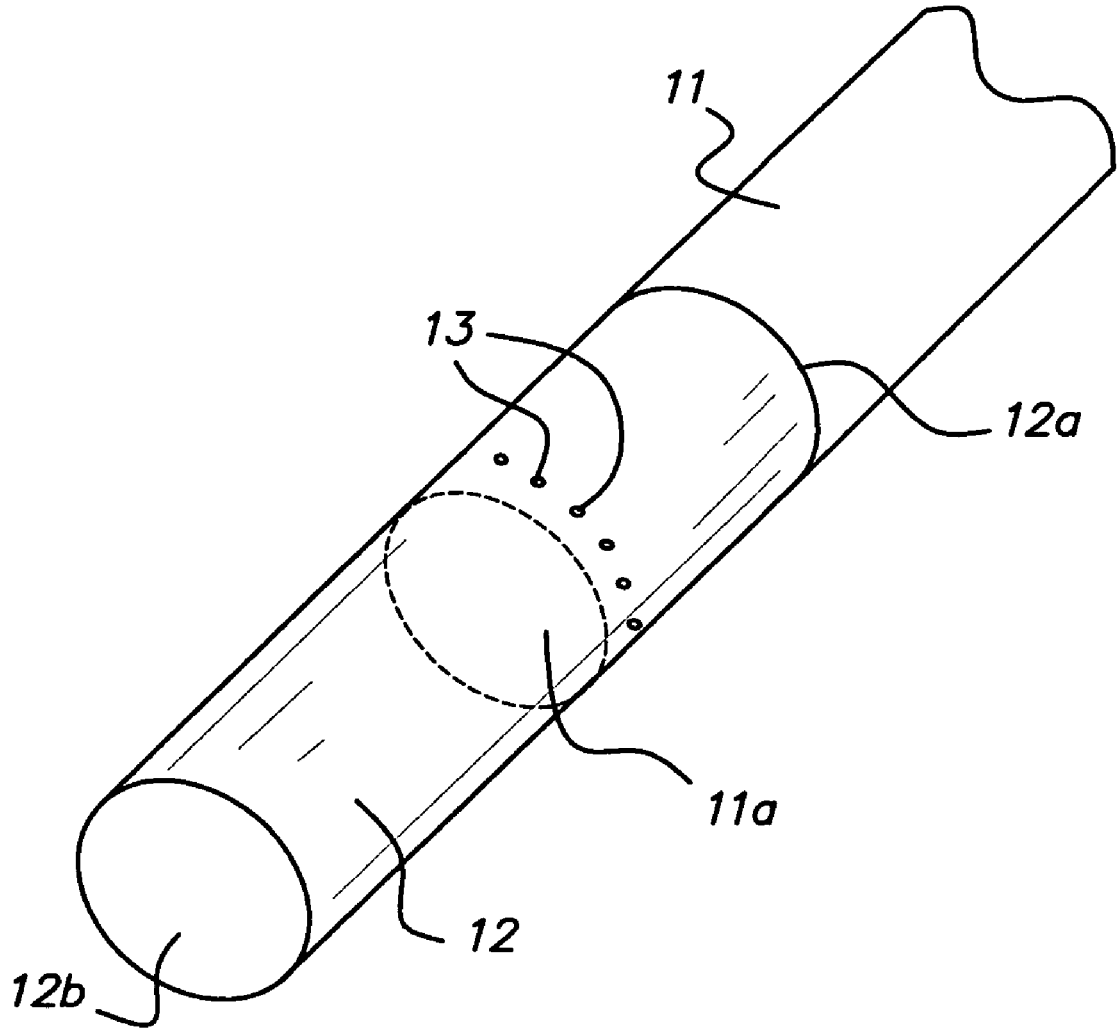
(PRIOR ART) FIG. 1
FIG. 1 is a perspective view illustrating a prior art sleeve mounting technique.
Figure 4:
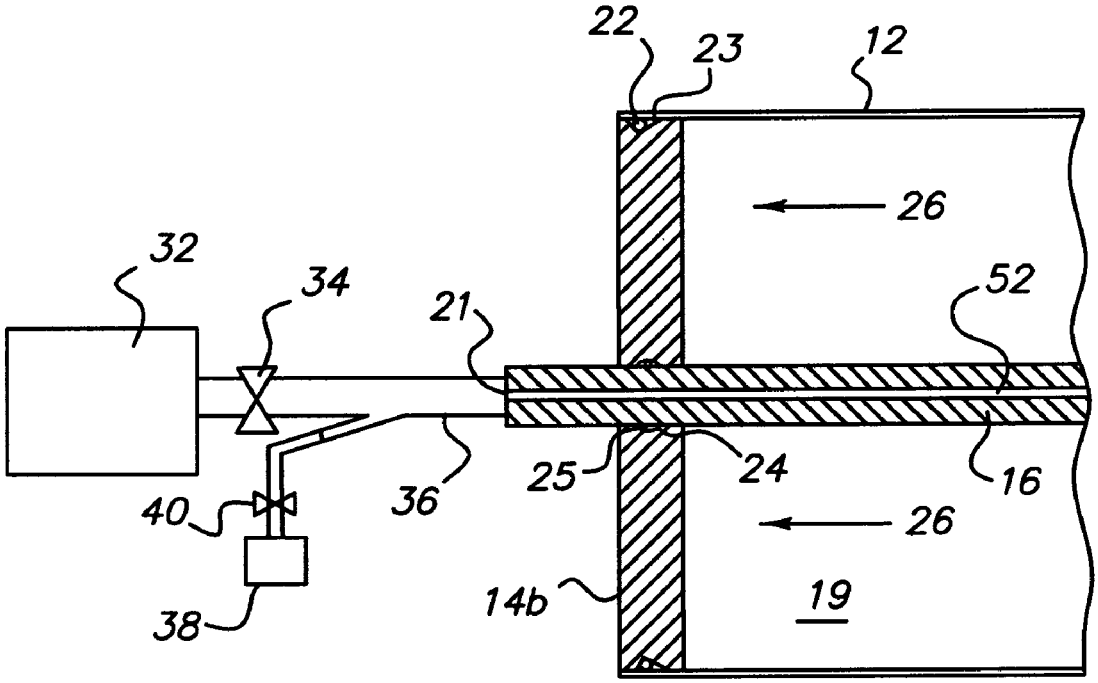
FIG. 4 is a partial side view of the end cap portion of the sleeve mounting apparatus.

One construction for securing end cap 14*b* to sleeve 12 while maintaining a seal is depicted in FIG. 4. End cap 14*b* has a wedge-shaped groove extending around its circumference. An o-ring 22 is retained in wedge shaped groove 23. In the illustrated embodiment groove 23 is asymmetrical and has a proximal, more gently sloping, sidewall 23*a* and a steeper sidewall 23*b*. The pressure in cavity 19 during dismounting generates an outward air pressure indicated by arrow 26 that tends to push end cap 14*b* out of the sleeve 12. Groove 23 helps o-ring 22 to maintain the seal in the face of increasing air pressure 26 in cavity 19 inside sleeve 12. As this force 26 is applied, end cap 14*b* tends to move outward, causing o-ring 22 to roll or move up the more gently angled wall 23*a* of groove 23. In this manner, o-ring 22 becomes more tightly wedged between end cap 14*b* and inner surface 12*d* of sleeve 12, providing a stronger gripping force against the inside cylindrical surface 12*d* of sleeve 12. The harder the air pressure 26 pushes against end cap 14*b*, the more strongly end cap 14*b* grips the inside cylindrical surface of sleeve 12.

Returning again to FIG. 2-A, an intermediate disk 15 is provided to support sleeve 12 at a point near end 12*a*. Intermediate disk 15 is annularly shaped and made from a ferromagnetic metal and is slideably located on handling shaft 16. The outer circumference of the intermediate disk engages the inside surface 12*d* of sleeve 12. Intermediate disk 15 is placed on the handling shaft 16 near the end 12*a* when mounting sleeve 12 and is retained by a plurality of magnets 17 recessed into the surface of handling shaft 16.

FIGS. 2-B to 2-D show steps in a method for mounting sleeve 12 to the cylinder 11. Proximate end cap 14*a* is first removed so that the sleeve 12 is supported by distal end cap 14*b* and intermediate disk 15, thus leaving sleeve end 12*a* open. The proximate end 16*a* of the handling shaft 16 is engaged in a socket 18 or other engagement mechanism in the free end 11*a* of cylinder 11. The engaging mechanism 18 on the cylinder 11 and the proximate end 16*a* of the handling shaft 16 are fitted, such that when they engage, the axial center of the sleeve 12 is substantially the same as the axial center of the cylinder 11. This concentric orientation of the sleeve 12 and the cylinder 11 is referred to herein as being aligned.

Once handling shaft 16 and the cylinder 11 are engaged and aligned, a flow of air or other suitable fluid is established through apertures 13. The next stage in mounting the sleeve 12 onto the cylinder 11 is depicted in FIG. 2-C. Sleeve 12 is initially pushed onto the proximate edge 11*a* of cylinder 11 by pushing on distal end cap 14*b*. There is no need to handle the sensitive exterior surface 12*c* of sleeve 12, or media mounted thereon. Once the proximate end 12*a* of sleeve 12 has been pushed past apertures 13, the pressurized air being expelled from apertures 13 exerts radial force on the interior cylindrical surface 12*d* of sleeve 12. This radial force expands sleeve 12 slightly in a radial direction, forming an air bearing and making it significantly easier to slide sleeve 12 farther onto cylinder 11.

The air coming out of the apertures 13 and forming the air bearing must escape somewhere. Some air escapes from the air bearing near the proximate end 12*a* of the sleeve 12 and vents into the atmosphere. The remaining air escapes between the sleeve 12 and the cylinder 11 near its free end 11*a* and flows into the closed cavity 19 formed by sleeve 12, distal end cap 14*b* and the free end 11*a* of cylinder 11. The air building up in the cavity 19 is mostly vented through an aperture 20 into handling shaft 16, which has a conduit formed therethrough. Some air may vent through the small gap between the end cap 14*b* and the handling shaft since if this seal is made too tight, end cap 14*b*, will have difficulty sliding on handling shaft 16.

Referring now to FIG. 4, handling shaft 16 has an internal conduit 52 between aperture 20 and a port 21 at its distal end 16*b*. Port 21 is connected to a vacuum source 32 via a coupler 36 and an in-line adjustable valve 34. When valve 34 is open and vacuum source 32 is operating, air from cavity 19 is evacuated at a faster rate than the airflow from apertures 13, thus lowering the pressure within cavity 19. The lowered pressure in cavity 19 draws sleeve 12 onto cylinder 11. The advance rate of sleeve 12 may be controlled by adjusting the vacuum established by source 32 by operating adjustable valve 34. In this manner, sleeve 12 may be loaded onto the cylinder 11 with virtually no touching or manipulation, even via end cap 14*b*.

As sleeve 12 is drawn further onto cylinder 11, intermediate disk 15 is held by magnets 17. As sleeve 12 advances, intermediate disk 15 is eventually contacted by end cap 14*b* and moved off magnets 17 to be sandwiched between the free end 11*a* of cylinder 11 and end cap 14*b*. End cap 14*b* has a plurality of magnets 50 for contacting the intermediate disk 50, the function of which is explained below.

FIG. 2-D shows sleeve 12 fully engaging cylinder 11. The pressurized air coming from apertures 13 is shut-off, reducing the axial pressure on the interior surface 12*d* of sleeve 12 and eliminating the air bearing. As a result, sleeve 12 shrinks and forms an interference fit on the exterior surface of cylinder 11. Handling shaft 16 is removed at this stage and a tailstock (not shown) engages the free end 11*a* of cylinder 11 with the end cap 14*b* and the intermediate disk 15 still in place. The sensitive media on the exterior surface of the sleeve 12 may now be imaged or used in a conventional manner.

After imaging or use, sleeve 12, which bears the imaged media must be removed from cylinder 11. The media is still susceptible to handling damage at this point. A sleeve removal process is depicted in FIG. 3. The preliminary steps for removal of sleeve 12 are shown in FIG. 3-A. The proximate end 16*a* of handling shaft 16 is engaged with the free end 11*a* of the cylinder 11 to align the two. Valve 34 in FIG. 4 is closed and pressurized air is applied via apertures 13 causing radial pressure on the interior surface of the sleeve 12 thus creating an air bearing. The air venting into cavity 19 causes an increase in pressure in cavity 19. This results in an axial force being applied against the interior surface of the substantially airtight end cap 14*b*. This axial force pushes sleeve 12 away from cylinder 11 and along the handling shaft 16 towards its distal end 16*b*. The axial force in combination with the air bearing support allows the sleeve 12 to be removed from cylinder 11 without physically manipulating any part of its exterior surface.

As sleeve 12 is pushed along handling shaft 16, the intermediate disk 15, attached to the end cap 14*b* via magnets 50, moves with the end cap 14*a* until it reaches magnets 17 in handling shaft 16. Magnets 17 provide a stronger attractive force than magnets 50 thus retaining intermediate disk 15 at the position of magnets 17 in order to support the open end of the sleeve 12.

It has been found that under the force of the pressurized air venting from apertures 13, sleeves may from time to time stick while being removed. This would necessitate handling of the proximate end 12*a* in order to release sleeve 12, which is highly undesirable. This problem may be resolved by incorporating an auxiliary pressurized air supply 38 as shown in FIG. 4. The auxiliary air supply 38 is connected to vented end 21 of handling shaft 16 via a branch in coupler 36. A valve 40 allows selective introduction of additional blasts of pressurized air to cavity 19 via coupler 36. Under normal sleeve removal conditions sleeve 12 is allowed to blow off the cylinder 11 under the forces exerted by pressurized air venting from apertures 13 only. Should a sleeve stick during removal, valve 40 maybe opened to provide additional pressurization of cavity 19 and thus additional force to the sleeve 12. As soon as sleeve 12 becomes unstuck, valve 40 may be closed. In the illustrated embodiment the auxiliary air supply valve 40 is controlled via a small push button switch located on a larger lever controlling valve 34.

FIG. 3-C depicts sleeve 12 completely removed from cylinder 11. Handling shaft 16 is now carrying sleeve 12 and is disengaged from cylinder 11. The proximate end cap 14*a* is reinserted into the proximate end 12*a* of the sleeve 12. By manipulating the ends of the handling shaft 16, the sleeve 12 may then be handled without touching the media. After imaging, the media on the exterior surface of the sleeve 12 may be further processed, if necessary, to develop the image.

Figure 5:
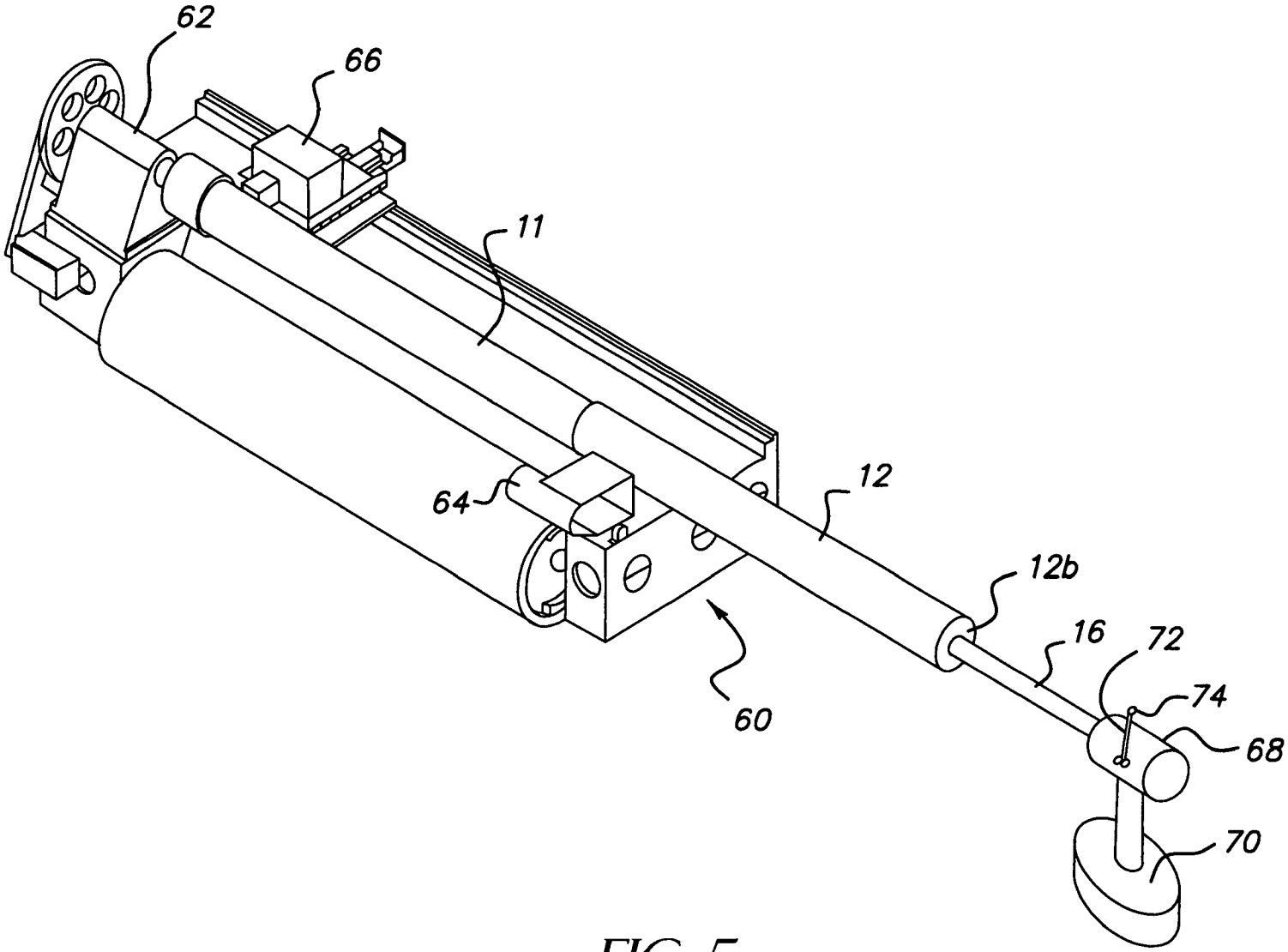
FIG. 5 is a perspective view of an imaging device according to an embodiment of the invention.

FIG. 5 depicts a flexographic imaging device 60 according to the invention. Device 60 comprises a cylinder 11 supported in a cantilevered condition by a headstock 62 so that the cylinder has an open end 64 which is partially engaged by sleeve 12. The device is further equipped with a moveable tailstock 64 that is pivoted out of engagement with cylinder 11 for the loading of a sleeve 12. An imaging head 66 is disposed to imagewise expose a media loaded on cylinder 12 as is well known in the art. Sleeve 12 is sealed at its distal end by end cap 14*b* which is slideably located on a handling shaft 16. Handling shaft 16 is rigidly cantilevered from a support 68 attached to a base 70 which is bolted to the floor of the plant housing device 60. A lever 72 controls the air supply as previously described, activating evacuation of cavity 19 to draw sleeve 12 onto cylinder 11. A push button 74 on lever 72 further activates the auxiliary air supply to aid in removing a sleeve that becomes stuck when dismounting. Support 68 may be selectively rotatable to align the handling shaft to more than one sleeve device such as an imaging device, a media mounting device, or a printing press.

As will be apparent to those skilled in the art in the light of the foregoing disclosure, many alterations and modifications are possible in the practice of this invention without departing from the spirit or scope thereof. For example:

Pressurized air may be replaced by some other pressurized fluid.

While the vacuum source and auxiliary air supply in the described embodiment are shown attached via handling shaft 16, this is not mandated. The vacuum and auxiliary air supply may equally well be applied through suitable passages in cylinder 11.

Although the invention is described above with reference to use on an imaging cylinder the invention may be applied in association with printing press cylinders, sleeve mounting cylinders, and other cylinder and sleeve applications.

The described embodiment of the invention shows only one set of apertures 13 at the free end 11*a* of the exterior cylindrical surface of the cylinder 11. However, the invention is not limited to having apertures in that location alone. For example, apertures located otherwise along the exterior cylindrical surface of the cylinder 11 may be provided. Such apertures may conduct pressurized air from a single source or from multiple sources. The vacuum source may be connected to the sleeve cavity via a conduit through the cylinder.

While in the preferred embodiment the sleeve is supported by a slideable end cap and intermediate disk on a handling shaft other means of supporting the sleeve may easily be envisaged that employ other well known mechanical devices or hardware.

The cylinder could be expandable to grip the sleeve. In this case it may be unnecessary to provide air to expand the sleeve or to make an air bearing between the sleeve and the cylinder.

Intermediate disk 15 need not be made entirely of ferromagnetic material. Disk 15 may comprise ferromagnetic material embedded within or attached to another material.

End cap 14*b* could be supplied as a part of cylinder 12.

The handling shaft could comprise a socket which is fittingly engageable with a projection on the end of the cylinder such that engagement of the socket on the projection supports the handling shaft in an aligned relationship with the cylinder.

Accordingly, the scope of the invention is to be construed in accordance with the substance defined by the following claims.

What is claimed is:

1. An apparatus for mounting a tubular sleeve on a cylinder, the cylinder having an open end with at least one air aperture formed in an outer surface of the cylinder proximate the open end, the air aperture for radially expanding the sleeve and providing air bearing flotation thereto, the air bearing being pressurized air provided through the at least one aperture, the apparatus comprising:

an end cap sealingly engaging an end of the sleeve distal to the cylinder open end so that at least a portion of the sleeve is free to engage the cylinder open end thus forming a substantially closed cavity between the end cap, the sleeve, and the cylinder open end;

an air supply for providing pressurized air through the at least one aperture to aid in mounting the sleeve onto the cylinder and in removing the sleeve from the cylinder;

a vacuum source for selectively evacuating air from the cavity to draw the sleeve onto the cylinder; and, an auxiliary air supply connectable to introduce additional pressurized air into the cavity to aid in removing the sleeve from the cylinder.

2. Apparatus according to claim 1, wherein the cylinder is one of:

an imaging cylinder;

a printing press cylinder; and a sleeve mounting cylinder.

3. Apparatus according to claim 1, comprising a handling shaft aligned with the open end of the cylinder wherein the end cap is slideably disposed on the handling shaft.

4. Apparatus according to claim 3, comprising an intermediate support for supporting the sleeve proximate to the open end of the cylinder.

5. Apparatus according to claim 4, wherein the intermediate support is slideably disposed on the handling shaft.

6. Apparatus according to claim 5, wherein the intermediate support comprises a disk sized to engage an inside surface of the sleeve.

7. Apparatus according to claim 6, wherein the intermediate support is ferromagnetic and the handling shaft comprises a plurality of recessed magnets for retaining the intermediate disk on the handling shaft.

8. Apparatus according to claim 7, wherein the end cap comprises at least one magnet disposed to engage the intermediate disk when removing the sleeve from the cylinder.

9. Apparatus according to claim 3, wherein the handling shaft comprises a conduit formed therethrough, a first end of the conduit connected to an aperture in the handling shaft proximate to the open end of the cylinder and a second end of the conduit connecting to the vacuum source.

10. Apparatus according to claim 9, comprising a valve connected between the aperture in the handling shaft and the vacuum source for controlling the evacuation of air from the cavity.

11. Apparatus according to claim 9, wherein the conduit comprises a branch connectible to the auxiliary air supply.

12. Apparatus according to claim 11, comprising a valve for selectively delivering air from the auxiliary air supply into the conduit.

13. Apparatus according to claim 3, wherein the handling shaft comprises a conduit formed therethrough, a first end of the conduit connected to an aperture in the handling shaft proximate to the open end of the cylinder and a second end of the conduit connecting to the auxiliary air supply.

14. Apparatus according to claim 13, comprising a valve connected between the aperture in the handling shaft and the auxiliary air supply for controlling the introduction of air from the auxiliary air supply into the cavity.

15. Apparatus according to claim 3, comprising a support for holding the handling shaft in a cantilevered condition, the support movable between a first position wherein the handling shaft is aligned with the cylinder and a second position wherein the handling shaft is aligned with another sleeve device.

16. Apparatus according to claim 1, wherein the end cap comprises an o-ring seal between the end cap and an interior cylindrical surface of the sleeve, the o-ring being housed in a seating with a gradual grade on an interior side, the gradual grade and the o-ring operative in combination, to provide an increasingly tight seal as fluid pressure is applied against the interior side of said end cap.

* * * * *